US012599954B2

(12) United States Patent
Otto

(10) Patent No.: US 12,599,954 B2
(45) Date of Patent: Apr. 14, 2026

(54) HYDRAULIC FORMING MACHINE FOR PRESSING WORKPIECES, IN PARTICULAR FORGING HAMMER, AND METHOD FOR OPERATING A HYDRAULIC FORMING MACHINE, IN PARTICULAR A FORGING HAMMER

(71) Applicant: LANGENSTEIN & SCHEMANN GMBH, Coburg (DE)

(72) Inventor: Markus Otto, Lautertal (DE)

(73) Assignee: LANGENSTEIN & SCHEMANN GMBH, Coburg (DE)

( * ) Notice: Subject to any disclaimer, the term of this patent is extended or adjusted under 35 U.S.C. 154(b) by 160 days.

(21) Appl. No.: 18/262,891

(22) PCT Filed: Jan. 24, 2022

(86) PCT No.: PCT/EP2022/051490

§ 371 (c)(1),
(2) Date: Jul. 25, 2023

(87) PCT Pub. No.: WO2022/157360

PCT Pub. Date: Jul. 28, 2022

(65) Prior Publication Data

US 2024/0173765 A1 May 30, 2024

(30) Foreign Application Priority Data

Jan. 25, 2021 (DE) ..... 102021101539.1

(51) Int. Cl.
*B21J 7/46* (2006.01)
*B21J 7/28* (2006.01)

(52) U.S. Cl.
CPC .. *B21J 7/46* (2013.01); *B21J 7/28* (2013.01)

(58) Field of Classification Search
CPC ..... B21J 7/04; B21J 7/28; B21J 7/40; B21J 7/46; B21J 9/12
See application file for complete search history.

(56) References Cited

U.S. PATENT DOCUMENTS 3,678,726 A * 7/1972 Hoffman ..... B21D 24/08 72/453.13
5,027,631 A * 7/1991 Naito ..... B21D 28/20 700/165

(Continued)

FOREIGN PATENT DOCUMENTS

CA 3111771 4/2020
CN 101947619 1/2011

(Continued)

OTHER PUBLICATIONS

CN 109500336A, Zhang et al. Mar. 2019.*

(Continued)

*Primary Examiner* — Edward T Tolan
(74) *Attorney, Agent, or Firm* — Workman Nydegger

(57) ABSTRACT

The underlying invention relates particularly to a hydraulic forming machine, more particularly a forging hammer, for workpiece forming, comprising a hydraulic cylinder for driving a ram configured for workpiece forming, and a hydraulic circuit configured for operation of the hydraulic cylinder, wherein the hydraulic circuit has an actuator with an adjustably variable volume flow via which a first hydraulic working chamber of the hydraulic cylinder, used to accelerate the ram during the execution of a working stroke (A) for workpiece forming, can be provided with hydraulic fluid. The hydraulic circuit is configured to adjust and vary the volume flow of the valve or actuator, depending on a setpoint speed (Vsoll) of the ram to be achieved in an (Continued)

acceleration phase of a working stroke (A), and to optimize the subsequent movement phase.

19 Claims, 6 Drawing Sheets

(56) References Cited

U.S. PATENT DOCUMENTS

| | | | |
|---|---|---|---|
| 5,499,525 | A | 3/1996 | Kordak et al. |
| 2010/0132349 | A1 | 6/2010 | Brahmer |
| 2014/0318390 | A1 | 10/2014 | Bauersachs et al. |
| 2018/0185900 | A1 | 7/2018 | Otto |
| 2022/0203642 | A1* | 6/2022 | Tabata ..... B30B 15/148 |

FOREIGN PATENT DOCUMENTS

| | | | |
|---|---|---|---|
| CN | 103459134 | A | 12/2013 |
| CN | 103711739 | A | 4/2014 |
| CN | 103978139 | A | 8/2014 |
| CN | 204756134 | | 11/2015 |
| DE | 1975013 | U | 12/1967 |
| DE | 19680008 | | 1/2002 |
| DE | 202014104509 | U1 | 10/2014 |
| DE | 102015105400 | A1 | 10/2016 |
| RU | 2327542 | | 6/2008 |
| WO | 2013167610 | | 11/2013 |
| WO | 2017216737 | | 12/2017 |
| WO | 2020/064931 | A2 | 4/2020 |

OTHER PUBLICATIONS

Translation CN 109500336A, Zhang et al. Mar. 2019.*

International Search Report for PCT/EP2022/051490 mailed May 12, 2022.

International Preliminary Report on Patentability received for PCT Patent Application No. PCT/EP2022/051490, mailed on Aug. 3, 2023, 15 pages (8 pages of English Translation and 7 pages of Original Document).

International Search Report and Written Opinion received for PCT Patent Application No. PCT/EP2022/051490, mailed on Jul. 25, 2022, 20 pages (9 pages of English Translation and 11 pages of Original Document).

Office Action received for Chinese Patent Application No. 202280024613.1, mailed on Jan. 14, 2026, 19 pages (11 pages of English Translation and 8 pages of Original Document).

* cited by examiner

HYDRAULIC FORMING MACHINE FOR PRESSING WORKPIECES, IN PARTICULAR FORGING HAMMER, AND METHOD FOR OPERATING A HYDRAULIC FORMING MACHINE, IN PARTICULAR A FORGING HAMMER

CROSS-REFERENCE TO RELATED APPLICATIONS

The present invention is a 35 U.S.C. § 371 U.S. National Stage of PCT Application No. PCT/EP2022/051490, filed on Jan. 24, 2022, which claims priority to DE 102021101539.1, filed on Jan. 25, 2021. The entire content of each of the aforementioned patent applications is incorporated herein by reference.

BACKGROUND OF THE INVENTION

1. Field of the Invention

The underlying invention relates to a forming machine, in particular a forging hammer, and a method for operating a forming machine, in particular a forging hammer.

2. Description of Related Art

Various forming machines are known for pressing workpieces in cold forming, in particular in sheet metal forming, or in hot forming, in particular when forging metallic, forgeable materials (see, for example, VDI lexicon volume on production engineering process engineering, publisher: Hiersig, VDI-Verlag, 1995, pages 1107 to 1113). At least one ram with a first forming tool of the forming machine is driven by a drive and moved relative to a second forming tool of the forming machine, so that the workpiece can be formed by forming forces between the forming tools.

Known hydraulic forming machines use a hydraulic drive by means of a hydraulic medium or hydraulic fluid, such as oil or water, the pressure energy of which is converted first into kinetic energy and finally, during the forming process, into mechanical forming work by pistons running in hydraulic cylinders, especially in forging hammers. The hydraulic drive of the piston can be a pump drive with a pump and an electrically controllable pump motor (see, for example, DE 196 80 008 C1) or a hydraulic accumulator drive with pressure accumulator and motor-driven pump for producing the pressure in the pressure accumulator (see, for example, WO 2013/167610 A1).

DE 10 2015 105 400 A1 discloses a forging hammer with a striking tool which is coupled to a hydraulic differential cylinder in order to carry out a working stroke or return stroke. To drive the differential cylinder, a hydraulic pump is provided which is connected to the cylinder chambers of the differential cylinder via a simple directional valve.

However, in the known forming machines, in particular the forging hammers, there is still potential for improving the movement sequences of the ram or of the associated tools, for example to improve the achievement of an exact forming speed and/or its reproducibility. It would also be desirable to improve forming machines of the aforementioned type in such a way that, during operation, the occurrence of cavitation in the hydraulic circuit, in particular in the hydraulic working chambers of the hydraulic cylinder, the valves and the lines of the control block, may be at least reduced, advantageously even substantially or completely avoided.

BRIEF SUMMARY OF THE INVENTION

In this respect, the object of the invention is to provide a new or improved hydraulic forming machine, in particular a forging hammer. In particular, a forming machine shall be provided that enables improved movement control and regulation of the ram with an impact tool for forming coupled thereto and/or that enables movement control with reduced or diminished formation of cavitation in the hydraulic medium or in the hydraulic fluid, in particular in the hydraulic working chambers of the hydraulic cylinder, the valves and the lines of the control block. Furthermore, a corresponding method for operating a hydraulic forming machine, in particular a forging hammer, shall be made available.

This object is solved by the features of the independent claims. Embodiments result in particular from the dependent claims and from the following description of exemplary embodiments and configurations.

According to a device-related embodiment of the invention, a hydraulic forming machine, in particular a forging hammer, is provided for workpiece forming.

The hydraulic forming machine, also referred to below for short as forming machine, comprises a hydraulic cylinder that is designed and configured to drive a ram or plunger configured for workpiece forming.

During operation, specific tools for the respective forming task are usually coupled to the ram or plunger, which tools form the workpiece when they act on a workpiece to be formed at the end of a working stroke or pressing stroke.

The working stroke is followed by a return stroke or retraction of the hydraulic cylinder, as a result of which the ram or plunger is brought into a position for executing a subsequent working stroke.

The hydraulic cylinder, for example a dual-action hydraulic cylinder, e.g. a differential cylinder, may, as is customary, comprise a piston that is movable to and fro in a cylinder chamber. The piston is coupled to one end of a piston rod, with the other end of the piston rod being coupled to the ram, for example. The ram is moved accordingly by the movement of the piston. By cyclical movement of the piston, forming operations can be carried out repeatedly.

To carry out a working stroke, which within the scope of this disclosure, means a movement of the hydraulic cylinder, in particular of the ram, that results in a forming operation, hydraulic fluid is applied to a first hydraulic working chamber of the hydraulic cylinder. At the same time, hydraulic fluid is displaced from a second hydraulic working chamber located on the opposite side of the piston. In particular, in a forging hammer with a differential cylinder, the second working chamber may be constantly pressurized while executing work cycles (each working stroke and return stroke). During the execution of a working stroke, the first hydraulic working chamber may be subjected to the same pressure (system pressure) as the second hydraulic working chamber. The hydraulic fluid supplied to the first hydraulic working chamber acts on the piston surface of the piston, and the pressure of the hydraulic fluid present in the second hydraulic working chamber acts on the annular surface of the piston, which is correspondingly smaller than the piston surface due to the coupled piston rod. The hydraulic fluid supplied to the first hydraulic working chamber thus produces a force acting on the piston, which is greater than the force acting on the piston from the second hydraulic working chamber via the annular surface of the annular space (product of pressure and surface area). A resulting force is created that accelerates the piston and therefore generates the working stroke. For the return stroke or retraction of the piston, accompanied by a corresponding movement of the ram, the pressurization in the first hydraulic working chamber is ended and the pressure constantly acting on the annular surface of the second hydraulic working chamber generates a force which is counter to the force acting during the working stroke and which brings about the return stroke or retraction. In a forging hammer, the pressurization of the first hydraulic working chamber, which leads to an accelerating force on the piston during the working stroke, is usually terminated before the start of the forming, such that the force acting on the piston via the annular surface from the end of the pressurization accelerating the piston in the second working chamber is initially negative in terms of an accelerating effect on the movement of the piston before the forming and the subsequent return stroke take place. So that the return stroke can take place, it is necessary for the hydraulic fluid to be able to escape from the first hydraulic working chamber, in particular as long as the return stroke movement is taking place. The hydraulic fluid exiting the first hydraulic working chamber is usually piped into a tank. In the working stroke phase between the end of the pressurization leading to acceleration of the piston in the first hydraulic working chamber and the start of the return stroke, it is necessary for hydraulic fluid to continue to flow or be able to flow into the first hydraulic working chamber, in particular in order to avoid low pressures or underpressure and cavitation resulting therefrom. In embodiments according to the invention, the inflow or ingress into the first hydraulic working chamber is made possible in this phase via a suction valve or via an, in particular controllable, actuator.

The hydraulic working chambers are also referred to herein for short as working chamber. Thus, a first working chamber designates the first hydraulic working chamber, and a second working chamber designates the second hydraulic working chamber.

The hydraulic forming machine also comprises a hydraulic circuit configured to operate the hydraulic cylinder. In the sense used here, the term hydraulic circuit in particular is to be understood in a general manner. In particular, the term hydraulic circuit shall not only cover hydraulic lines, but also, depending on the context, additional parts and components such as control units, regulating units, valves, pumps, etc., which are present or required for the hydraulic operation of the hydraulic cylinder.

In one embodiment, the hydraulic circuit comprises a valve with an adjustably variable volume flow. The term adjustably variable is to be understood here as meaning that the volume flow of the valve may be adjusted and at the same time allows variable, in particular time-variable, for example controllable, settings of the volume flow. Such a valve differs from a conventional on-off valve with only two selectable switch positions in that several or a large number of switch positions may be selectively set. In particular, such valves may be designed in such a way that the volume flow may be adjusted substantially continuously or steplessly, and that the opening state of the valve, in particular the opening width and opening time, may be adjusted, in particular controlled or regulated, in a targeted manner, e.g. over time according to a function of time or as a function of other variables. In particular, controllable valves that allow the volume flow or the opening width and/or opening time to be adjusted by means of control technology are suitable. Examples of such valves are given below. A regulating directional control valve is mentioned as an example at this point, in which the opening width may be changed under voltage or current control and, depending on the applied voltage, can be selectively opened or closed continuously, for example according to a function of time, e.g. a ramp.

The valve is installed in the hydraulic circuit in such a way that hydraulic fluid can be applied to the first hydraulic working chamber of the hydraulic cylinder, which is used to accelerate the ram when executing the working stroke for workpiece forming. The valve may, for example, connect the first working chamber to a hydraulic reservoir, in particular a pressure reservoir, and/or a pump unit via hydraulic lines. If the valve is opened, the hydraulic fluid coming from the reservoir and/or the pump unit is applied to the first working chamber. The hydraulic pressure prevailing in the hydraulic fluid acts on the pressing surface of the hydraulic cylinder and generates a force to carry out the working stroke. If a differential cylinder is used, the side of the piston facing away from the piston rod, i.e. the piston surface, is usually used as the pressing surface, and the ring surface on the piston rod side is used as the retraction surface. For the return stroke or retraction, the annular surface in the second working chamber may be connected to a pressure reservoir and/or a pump unit, e.g. with simultaneous connection of the first working chamber to a tank to reduce the pressure applied to the piston surface, so that the compressive force generated via the annular surface is sufficient to move the components that are to be moved, e.g. ram, tool, piston rod, piston, hydraulic fluid of the first working chamber, etc., and to retract the hydraulic cylinder or piston.

The hydraulic circuit of the present embodiment is, in particular, configured to adjust and vary, in particular to regulate, the volume flow of the valve depending on a setpoint speed of the ram that is to be achieved in an acceleration phase of the working stroke. For example, the hydraulic circuit may comprise a controller or a control unit that is configured to adjust the volume flow, for example the opening width of the valve over time, so that the setpoint speed is reached within a predefined or definable stroke range of the piston. To adjust and vary the volume flow, a corresponding regulating unit, in particular a control unit, may for example use data stored in a table of values, which data specify volume flows to be set over time in order to achieve the desired setpoint speed for the respective operating conditions and operating parameters, such as, for example, forming machine, ram type, ram weight, tool height, tool weight, type of forming, type of material, etc., or from which the regulating unit may determine the volume flows that are to be set. Alternatively or additionally, the forming machine may have one or more pressure, path, speed and/or acceleration sensors, and the regulating unit may use measurement data from such sensors when adjusting the volume flows in order to achieve the setpoint speed. In some embodiments, the regulating unit may be configured to adjust, in particular dynamically adjust, the volume flow at least temporarily or partially, on the basis of measured values from the aforementioned sensors, for example in order to maintain the setpoint speed within a predefined stroke range during a working stroke. After the required setpoint speed has been reached, the acceleration of the piston acting in the direction of the working stroke is terminated by means of the inflow of hydraulic fluid into the first working chamber being adjusted.

In a first embodiment, the hydraulic circuit may comprise a suction valve connecting the first hydraulic working chamber to a reservoir, in particular to a suction tank, for hydraulic fluid. The suction valve is configured to fill the first working chamber with hydraulic fluid from the reservoir during the working stroke in a movement phase following the acceleration phase.

The movement phase of the working stroke may in particular be a braking phase in which the ram is no longer hydraulically accelerated, and the desired or adjusted setpoint speed required for the forming that was reached at the start of the phase is essentially maintained. It is possible to speak of a braking phase when further accelerating forces, such as gravity, act on the ram during the movement phase, which forces would lead to a further increase in the setpoint speed. If, for example, the forming machine is configured in such a way that in the acceleration phase the force of gravity, or a component of the force of gravity, acts in the direction of the movement of the ram and of the components moved with it, such as plunger, tool, etc., the force of gravity or the component of the force of gravity acts as an accelerating force. This is the case, for example, if the forming machine is configured in such a way that the ram or plunger is moved parallel to the force of gravity or perpendicular to the machine base or machine foundation, and the movement in the acceleration phase is in the direction of the force of gravity or towards the machine base. If the setpoint speed is reached in the acceleration phase by applying hydraulic fluid to the first working chamber, gravity continues to act as an accelerating force in the aforementioned machine structure. So that the setpoint speed that has been reached may be maintained, a braking force that counteracts gravity is required, i.e. the movement phase forms a braking phase. In the case of other structures, for example when the ram moves upwards counter to gravity in the acceleration phase, the movement phase may have correspondingly different force effects. Overall, the movement phase is set up such that the setpoint speed reached in the acceleration phase is essentially maintained.

Due to a pressure constantly present in the annular space of the cylinder, braking forces, i.e. negatively accelerating forces, may be generated in the movement phase of the working stroke following the acceleration phase. During the braking phase, the loading of the first hydraulic working chamber with a pressure leading to an acceleration in the direction of the working stroke is terminated. Since the piston continues to move in the direction of the working stroke during the movement phase, it is necessary, after the pressurization leading to the acceleration is terminated, for hydraulic fluid to be able to flow into the first working chamber. This is because the volume in the first working chamber of the cylinder, which continues to increase during the working stroke in the movement phase, would otherwise lead to a reduction in pressure and thus to cavitation, i.e. outgassing of the air dissolved in the hydraulic fluid, with resulting cavitation damage and stalling of the hydraulic fluid column.

In the embodiments proposed herein, the hydraulic circuit may be configured in such a way that in the movement phase, which is a braking phase, the pressure prevailing in the first working chamber, is for example above 1 bar, but in any case above the cavitation pressure of the hydraulic fluid. In this way, cavitation caused by outgassing of the hydraulic fluid may be avoided in the first working chamber.

To avoid cavitation in the first working chamber during the braking phase, the volume flow of hydraulic fluid into the first working chamber may for example be set or controlled such that the pressure in the first working chamber may be kept essentially above the cavitation pressure. This counteracts a further drop in the pressure in the first working chamber, with the aim of avoiding or essentially preventing a drop in the pressure below the cavitation pressure. According to the embodiments proposed here, the volume flow required in the braking phase into the first working chamber may be made available by means of a separate suction valve or post-flow valve and/or by an actuator, e.g. a directional control valve, provided for executing the working stroke.

In first embodiments according to claim 1, it is advantageously possible for example, by using a valve that may be adjusted, in particular controlled, in the volume flow, to set the volume flow in the acceleration phase as a function of the setpoint speed in such a way that the suction phase, i.e. the phase in which the first working chamber sucks in hydraulic fluid via the suction valve or in which hydraulic fluid flows into the first working chamber, is shortened, preferably minimized or optimized. At low setpoint speeds, for example, the volume flow into the first working chamber during the acceleration phase of the working stroke may be set correspondingly smaller, such that the acceleration phase extends over a larger part of the stroke until the setpoint speed is reached, as a result of which the suction phase may be advantageously shortened as compared to an operation at maximum volume flow or pressure in the acceleration phase. This is particularly advantageous since short suction phases generally involve less risk of cavitation compared to long suction phases. By virtue of the fact that the valve is adjustable and variable in the volume flow, it is possible, for different setpoint speeds, which, among other things, are dependent on the respective forming task, and the material used, to maximize or optimize the acceleration phase and to accordingly maximize or optimize the suction phase. The advantage of such a variable setting of the acceleration and suction phase, in particular with a minimal or optimized suction phase, is also that the reservoir or the suction tank may be of smaller dimensions. Furthermore, with a shortened, minimal, or optimal suction phase, the volumes of hydraulic fluid taken from and fed back to the reservoir are correspondingly smaller, so that the reservoir is as a whole calmer in successive forming cycles, which brings additional advantages in terms of avoiding cavitation. Furthermore, operation with a shortened, minimal, or optimal suction phase is also less susceptible to cavitation in the first working chamber, since cavitation essentially only occurs in the suction phase.

In some embodiments, the valve, as has already been indicated, may be designed as a controllable valve. For example, directional continuous valves, directional proportional valves, directional servo valves, and/or directional control valves are suitable for the valve. To control such a valve, the hydraulic circuit may comprise a corresponding control unit. The control unit may be configured to set the valve, and thus the volume flow, in such a way that, depending on the setpoint speed to be achieved and on the available stroke of the hydraulic cylinder, the setpoint speed and, at the same time, a short, in particular minimal or optimal, movement phase may be achieved. The respective actual position and/or actual speed or variables characterizing the position or speed may be determined, for example by one or more sensors of the forming machine. In the case of a control, for example, the actual speed may be used as the controlled variable and the setpoint speed may be used as the reference variable, and the control may bring about a corresponding adjustment and variation of the volume flow. In addition, the stroke range (ratio of acceleration phase to movement phase) travelled in order to achieve the setpoint speed, and other variables, may be used in the control process. Depending on the deviation, determined by the control, between the actual speed and the setpoint speed, the control may accordingly adjust the valve, i.e. the volume flow, for example in such a way that the setpoint speed may be achieved at a predetermined stroke of the hydraulic cylinder. Alternatively, the valve, i.e. the volume flow, may be set or controlled, for example, based on values from a table of values. Such a table of values may be obtained, for example, from test runs or simulations.

In second embodiments according to claim 3, a hydraulic forming machine, in particular a forging hammer, is provided for workpiece forming.

The hydraulic forming machine according to claim 3 comprises a hydraulic cylinder for driving a ram configured for workpiece forming, and a hydraulic circuit configured to operate the hydraulic cylinder and having an actuator for adjusting a volume flow of hydraulic fluid for filling a first hydraulic working chamber of the hydraulic cylinder during the execution of a working stroke immediately preceding the workpiece forming. The working stroke comprises an acceleration phase for accelerating the ram to a setpoint speed, and a movement phase, which follows, in particular directly follows, the acceleration phase. In this embodiment, the hydraulic circuit and the actuator are configured to adjust and vary, in particular to control, the volume flow into the first working chamber, in the acceleration phase of the working stroke for accelerating the ram to the setpoint speed, as a function of the setpoint speed, such that the setpoint speed is reached. Furthermore, the hydraulic circuit and the actuator are configured to reduce the volume flow in the subsequent movement phase of the working stroke to a post-flow volume flow, in particular to reduce it in a controlled manner, or to adjust and vary or control the volume flow in such a way that the hydraulic pressure prevailing in the first hydraulic working chamber in the movement phase is substantially above the cavitation pressure of the hydraulic fluid. As per the discussion above, the movement phase may be a braking phase. The cavitation pressure is to be seen here in relation to the hydraulic fluid in the first hydraulic working chamber. To adjust and vary, in particular control, the volume flow, the forming machine may comprise a control unit.

By comparison with the forming machine according to claim 1, the hydraulic forming machine does not require a suction valve and suction tank. The volume flow required to avoid cavitation-critical pressure is fed to the first working chamber in the movement phase via the actuator, also known as the impact valve in the case of forging hammers.

In the following, the phase in which hydraulic fluid is fed into the first working chamber via the actuator in order to avoid cavitation in said first working chamber is referred to as the post-flow phase or post-flow, since it does not actually involve suction, particularly since this is to be avoided.

For the post-flow, the control valve may be pressure-controlled starting from the end of the acceleration phase of the working stroke, i.e. when the setpoint speed has been reached, i.e. the opening cross section and the associated volume flow may be changed in real time depending on the conditions in the piston chamber. In particular, it is possible that the actuator is not closed abruptly after the end of the acceleration phase, but instead closed continuously, until a control of the actuator begins, which then controls the pressure in the first working chamber to a level above the cavitation pressure. The parameters required to control the actuator may be determined or fed back by sensors (control loop). For example, in the context of controlling the pressure in the first working chamber to a value above the cavitation pressure, the pressure in the first working chamber may be determined or fed back by one or more pressure sensors installed at the first hydraulic working chamber. A stalling of the hydraulic fluid column or cavitation, and damage thereto, may thus be substantially or completely prevented.

An advantage of the embodiment described in connection with claim 3 is in particular that the suction valve described in connection with the embodiment according to claim 1 may be omitted. Instead, the first working chamber is filled with hydraulic fluid in the movement phase or post-flow phase or post-flow, in particular in the braking phase, by appropriate setting, in particular controlling, the actuator.

In particular, the actuator may be set and varied, in particular controlled or regulated, in such a way that sufficient hydraulic fluid may flow into the first working chamber via the actuator in the movement phase, in particular the braking phase. For example in such a way, that cavitation is avoided. In particular, the post-flow of hydraulic fluid may be set and varied, in controlled regulated, in such a way that the pressure in the first working chamber is kept above the cavitation pressure, and that the setpoint speed reached or set in the acceleration phase of the working stroke is kept essentially constant in the movement phase of the working stroke.

The volume flow of the actuator may be set, in particular controlled, for example based on a respectively measured actual position, a respectively measured actual speed, and/or a respectively measured actual pressure in the first working chamber. To measure the respective actual values, the forming machine may comprise appropriate sensors, i.e. one or more position, speed and/or pressure sensors.

When using the actual pressure of the first working chamber, the setting of the actuator may take place, for example starting from the time when the setpoint speed is reached, additionally or exclusively on the basis of the measured actual pressure. However, the actuator may also be set in the acceleration phase on the basis of the respectively measured actual pressure. For example, the actual pressure measured during the acceleration phase may be used to suitably set the length of the acceleration phase and/or the movement profile or the movement sequence of the ram. In particular, it is possible to describe the temporal and/or local movement sequence of the ram using a setpoint table or setpoint function for the pressure in the first working chamber, and to set the actual pressure on the basis of the setpoint table or the setpoint function by setting the actuator. The same applies to the position and speed of the ram. It is likewise possible for the volume flow to be set and varied, in particular controlled, in accordance with a predetermined table of values and/or (setpoint) function.

Setpoint tables or (setpoint) functions may be determined by test runs or trial runs and/or by simulation under given boundary conditions, e.g. comprising the mass of the ram and of components moved therewith, the stroke of the hydraulic cylinder, the nature of the hydraulic fluid (viscosity, etc.). The setpoint tables or (setpoint) functions may be stored, for example, in an electronic memory of the forming machine and may be made available to a setting unit, in particular a controller, for setting the actuator.

With the proposed embodiment of the forming machine comprising the actuator with an adjustably variable volume flow, analogously to the above embodiments, it may advantageously be achieved that the acceleration phase can be lengthened relative to the movement phase or braking phase. By shortening or optimizing the movement phase, in particular the braking phase, cavitation in particular can be reduced or even completely avoided in the first working chamber since, as has been mentioned, such cavitation may occur in this phase. With the proposed possibility of setting the actuator on the basis of the actual pressure in the first working chamber, it is likewise possible to counteract the formation of cavitation based on a direct pressure measurement. For example, the pressure in the movement phase may be controlled by corresponding regulation of the actuator, in such a way that the actual pressure is prevented from falling below the cavitation pressure. With the described pressure-based setting of the actuator in the post-flow phase, the suction valve and the suction tank may, in particular, be omitted. An advantage in terms of hydraulic operation may be seen, for example, in the fact that actuators usually have shorter response times than suction valves, so that cavitation may be avoided with greater certainty. For example, in the case of suction valves, which correspond in design and function to a non-return valve, it may happen that they do not open or do not fully open in comparatively short suction phases and/or do not open fast enough at high setpoint speeds because of the longer response times. These disadvantages may be avoided with the pressure-based control of the actuator in the post-flow phase, in which hydraulic fluid flows into the first working chamber.

In some embodiments, the actuator may comprise a controllable valve and/or a controllable pump. The valve may comprise, for example, a directional continuous valve, a directional proportional valve, a directional servo valve, and/or a directional control valve. The pump may comprise a servo pump, for example. Using the aforementioned valves or pumps permits the implementation of advantageous, in particular relatively short, setting times for setting and varying the volume flows, and in particular a comparatively precise and/or repeatable execution of a movement cycle for workpiece forming. Comparatively short setting times and comparatively fast reaction and response times may also be achieved with such actuators, as a result of which cavitation, in particular even during short braking phases or post-flow phases, may be avoided at least substantially or even completely.

According to some embodiments, the hydraulic forming machine may further comprise at least one pressure sensor. The pressure sensor is configured at least to measure the hydraulic pressure prevailing in the first and/or second hydraulic working chamber during the working stroke and/or return stroke. The pressure sensor may, for example, be integrated into or attached to a hydraulic line connected to the first or second working chamber.

The hydraulic circuit or the setting unit, in particular a regulating unit or control unit, may be configured to adjust and vary, in particular control, the volume flow during a working cycle of the ram, but at least in the movement phase, preferably also in the return stroke, depending on the hydraulic pressure measured with the at least one pressure sensor.

A Control may be based on a predefined or predefinable hydraulic pressure, hydraulic pressure interval, and/or a predefined or predefinable temporal or local hydraulic pressure profile as a reference variable. For example, the hydraulic pressure or its profile for the time span of a working stroke or return stroke or for the position of the ram or the piston of the hydraulic cylinder during a working stroke or return stroke may be predefined or predefinable.

Corresponding hydraulic pressures and/or profiles may be obtained, for example, from a test operation of the forming machine and/or from simulations.

The above wording, according to which the volume flow may be adjusted and varied at least in the movement phase as a function of the hydraulic pressure, is intended to mean in particular that the setting or changing of the volume flow on the basis of the hydraulic pressure measured in the first working chamber (i.e. the actual hydraulic pressure) is not limited to the movement phase, but may also be carried out in the acceleration phase. Furthermore, it is possible to take into account a hydraulic pressure measured in the second working chamber during the working and/or return stroke.

According to some embodiments, the hydraulic circuit or the actuating unit, in particular a regulating unit, for example a control unit, may be configured to adjust and vary the volume flow in such a way that the hydraulic pressure in the first hydraulic working chamber in the movement phase corresponds to a predefined or predefinable pressure or is with a predefined or predefinable pressure range. For example, the predefined or predefinable pressure or pressure range may be between 2 and 6 bar, in particular 3 and 4 bar. The predefined pressure or pressure range is preferably predefined in such a way that in the movement phase, in particular the braking phase, the hydraulic pressure in the first working chamber is above the cavitation pressure of the hydraulic fluid. Cavitation may thus be avoided at least to a large extent.

According to some embodiments, the hydraulic circuit, in particular a regulating unit, for example an open-loop or closed-loop control unit, is configured to adjust and vary the volume flow depending on the setpoint speed that is to be achieved in each case. For example, the hydraulic circuit, in particular the regulating unit, may be configured to adjust the volume flow based on a table of values for setpoint speeds and/or to dynamically adjust, in particular regulate, the volume flow based on measured location and/or speed data of the ram or of the piston and/or measured hydraulic pressures. For this purpose, the forming machine may, for example, comprise at least one sensor unit for measuring and/or storing location and/or speed data of the ram or piston and/or the hydraulic pressures.

According to embodiments proposed here, the hydraulic circuit may be configured to close the valve or the actuator substantially completely at least temporarily in the movement phase of the working stroke that follows the acceleration phase, in particular shortly before or exactly at the start of the forming, in order to avoid possible hydraulic backblows into the system. In some embodiments of the forming machine with a suction valve in which, in the movement phase, in particular the braking phase, the hydraulic fluid required to avoid cavitation is provided via the suction valve, the suction valve is designed as a check valve for this purpose.

According to some embodiments, the hydraulic circuit is configured to adjust and vary, in particular to control, the volume flow in such a way that the acceleration phase is maximized while at the same time the movement phase is minimized or optimized. For example, it may be provided that the volume flow in the acceleration phase is adjusted in such a way that the suction phase or post-flow phase corresponds to a range of 10% to 30%, in particular 10% to 20%, of the stroke of the hydraulic cylinder. In particular, the volume flow for accelerating the ram may be adjusted and varied in such a way that the time remaining after the acceleration phase until immediately before the forming process is longer than the setting, response and/or switching times of the valve, the suction valve, or the actuator. By appropriately setting and varying the volume flow in the acceleration phase, it is possible to adjust the length of the acceleration phase and correspondingly the length of the movement phase or braking phase or their ratio, for example, also as a function of the setpoint speed that is to be achieved in each case.

For example, at low setpoint speeds, the volume flow may be increased or adjusted more slowly and with a smaller increase or lower rate of change, so that the setpoint speed is reached in a late phase of the working stroke, e.g. in the last third of the working stroke. At high setpoint speeds, the volume flow may be increased correspondingly faster, for example in such a way that the setpoint speed is likewise reached in a late phase of the working stroke.

In some embodiments, it is possible, for a working stroke for accelerating the ram, starting from a reversal point located in the movement profile of the ram with zero ram speed to the setpoint speed, to use only part of the total stroke of the hydraulic cylinder. Accordingly, the return stroke may be shortened, in particular in such a way that the setpoint speed may be reached reliably, in particular reproducibly, in the partial stroke available starting from the return stroke position and up to the forming position. The return stroke positions suitable for the given setpoint speeds may be obtained, for example, from test runs or trial runs and/or by simulation, and may be made available, for example, in the form of a table of values in a database of a regulating unit or control unit of the forming machine or of the hydraulic circuit.

When the return stroke path is shortened, for example at comparatively low setpoint speeds, it is possible to increase the frequency for forming operations of the forming machine, and/or to save energy by shortening the return stroke path.

According to method-related embodiments of the invention, a method for operating a hydraulic forming machine for workpiece forming is provided. To carry out the method, a forming machine may be used, for example, which is designed or configured according to one of the embodiments described herein in accordance with the invention.

According to one embodiment of the method, in a working stroke executed for workpiece forming, a ram provided or configured for workpiece forming is accelerated in an acceleration phase by a hydraulic cylinder coupled to the ram. In the acceleration phase, in the working stroke, a first hydraulic working chamber of the hydraulic cylinder is fed with hydraulic fluid via a valve with an adjustably variable volume flow through a hydraulic circuit. In particular, the method comprises feeding the first working chamber through the valve with an adjustably variable volume flow.

In the proposed method, it is provided that the hydraulic circuit adjusts and varies, in particular controls, the volume flow of the valve in the acceleration phase as a function of a setpoint speed of the ram that is to be achieved in the acceleration phase.

Furthermore, according to one aspect of the invention, it is provided that the first hydraulic working chamber is filled in a movement phase following the acceleration phase, in particular a braking phase, by a suction valve which is present in the hydraulic circuit and which connects the first hydraulic working chamber to a reservoir for hydraulic fluid.

The advantages described in connection with the forming machine proposed here may be achieved accordingly with the method. In particular, by adjusting and varying the volume flow, in particular by controlling the volume flow, depending on the setpoint speed to be achieved, it is possible to shorten the suction phase in the case of a forming machine with suction valve, as a result of which, for example, the hydraulic fluid in the reservoir may be calmed down and/or the risk of cavitation in the first working chamber may be reduced.

By adjusting and varying the volume flow, it is possible in particular to adjust the volume of hydraulic fluid flowing into the first working chamber per unit of time and also the time interval in which hydraulic fluid flows into the first working chamber, in particular based on a control or a control circuit. It is therefore possible, for example, to set the opening width of the valve and the duration of opening, in particular the filling time, in a selective and variable manner. The volume flow may, for example, be adjusted and/or varied according to a function of time. This makes it possible, for example, to set the duration of the acceleration phase, in particular as a function of the setpoint speed. For low setpoint speeds, for example, a small opening width combined with a correspondingly longer filling time compared to large opening widths may be implemented by a control. At high setpoint speeds, the opening width may be chosen to be larger. It is therefore possible in particular to extend the acceleration phase, for example, to just before the forming process, both at low and at high setpoint speeds, such that the movement phase or braking phase in which hydraulic fluid is sucked into the first working chamber may be reduced to a minimum or may be optimized for more reliable suction.

According to method-related embodiments, the valve may be designed as a controllable valve. The valve may comprise a directional continuous valve, a directional proportional valve, a directional servo valve, and/or a directional control valve. The method may comprise controlling the volume flow, wherein, in particular, the opening width and opening duration of the valve may be controlled.

In a method proposed according to a further aspect of the invention for operating a hydraulic forming machine for workpiece forming, a ram provided for the workpiece forming is accelerated in an acceleration phase, in a working stroke executed for the workpiece forming, by a hydraulic cylinder coupled thereto. The forming machine may be designed according to an embodiment described herein according to the invention.

The method according to the further aspect provides that, in the working stroke, a first hydraulic working chamber of the hydraulic cylinder is fed with hydraulic fluid via a valve with an adjustably variable volume flow through a hydraulic circuit. In the acceleration phase, the volume flow is adjusted and varied, in particular controlled, by the actuator as a function of the setpoint speed through the hydraulic circuit, in such a way that the setpoint speed is reached. In the movement phase immediately following the acceleration phase, the hydraulic circuit reduces the volume flow by appropriately setting the actuator to a post-flow volume flow in such a way that the hydraulic pressure prevailing in the movement phase (braking phase) in the first hydraulic working chamber is substantially above the cavitation pressure of the hydraulic fluid. The setting or adjusting and varying of the actuator may in particular include controlling the actuator.

Analogously to the above, the proposed actuator allows the acceleration phase, in particular the length of the acceleration phase, to be adapted to the setpoint speed. In particular, it is possible to set the acceleration phase in such a way that the subsequent movement phase or braking phase is shortened to a minimum or optimized.

Furthermore, the actuator or the valve with an adjustably variable volume flow makes it possible to influence the opening and closing behaviour. Compared to a sudden opening and closing of the hydraulic supply into the first working chamber, as in the case of a forming machine with an open-close valve according to the prior art, it is possible, with the proposed invention, to specifically influence or adjust and vary the opening and closing behaviour, in particular to control it, and to adapt the switching on and off of the hydraulic fluid flows, e.g. oil flows, to the inertia of actual component parts (ramps), in order to counteract or prevent stalling of the flows of hydraulic fluid.

According to an embodiment, the actuator may comprise a controllable valve and/or a controllable pump. With such actuators, it is possible to adjust, in particular control or regulate, the volume flow over time, for example according to a predefined or predefinable time function. Advantages associated with this have already been mentioned before.

The valve may comprise, for example, a directional continuous valve, a directional proportional valve, a directional servo valve, and/or a directional control valve. The pump may comprise a servo pump, for example.

In the method, the volume flow may be controlled as a function of the setpoint speed when using the aforementioned actuators.

According to one embodiment of the method, the volume flow during the working stroke, in particular during the movement phase, is adjusted such that a predefined or predefinable hydraulic pressure or hydraulic pressure curve is essentially achieved in the first hydraulic working chamber. The volume flow may be dynamically adjusted and varied, in particular controlled, for example based on a hydraulic pressure measured in the first hydraulic working chamber by means of a pressure sensor. In the method, the hydraulic pressure in the first working chamber may be measured accordingly. The hydraulic pressure or hydraulic pressure curve may be read from a table of values or database and used to adjust the volume flow, in particular to control or regulate it. It is also possible for hydraulic pressure prevailing in the second working chamber to be measured in a working cycle and be used to control the working stroke and/or return stroke.

According to one embodiment, the volume flow is adjusted and varied, in particular controlled, in such a way that the hydraulic pressure in the first hydraulic working chamber in the movement phase corresponds to a predefined or predefinable pressure or is within a predefined pressure range. The predefined pressure or pressure range may be between 2 and 6 bar, preferably between 3 and 4 bar. In particular, the volume flow may be adjusted and varied, in particular regulated, in such a way that the hydraulic pressure in the first working chamber is above the cavitation pressure of the hydraulic fluid.

According to one embodiment of the method, the volume flow is adjusted and varied, in particular controlled or regulated, as a function of the setpoint speed to be achieved in each case. The volume flow is preferably adjusted and varied, in particular dynamically adjusted, based on a table of values for setpoint speeds and/or based on measured location and/or speed data of the ram. The table of values may be determined, for example, from test runs or by simulation. In the method, it is further possible that location and/or speed data of the ram or of a component of the forming machine moved therewith and/or the measured hydraulic pressures are measured and/or stored, in particular temporarily stored, by at least one sensor unit. The measured and/or stored data may be used when setting and varying, in particular controlling, the volume flow.

According to one embodiment of the method, the valve or the actuating unit may be substantially completely closed at least temporarily in the movement phase following the acceleration phase. If the valve or actuator is substantially completely closed, then, in a method-related embodiment with suction valve, hydraulic fluid is supplied to the first hydraulic working chamber substantially completely via the suction valve in the movement phase, in particular the braking phase. In embodiments without suction valve, provision is made for the actuator to be adjusted, in particular controlled, in such a way that sufficient hydraulic fluid may flow in via the actuator.

According to a method-related embodiment, the volume flow is adjusted and varied, in particular controlled, in such a way that the duration of the acceleration phase is maximized or optimized while at the same time the duration of the movement phase is minimized. For example, the acceleration phase may thus be adjusted in such a way that the setpoint speed is reached shortly before the forming operation, so that in some embodiments the suction phase, in other embodiments the post-flow phase, is shortened or optimized, and associated disadvantages, e.g. stalling of the hydraulic fluid flow, formation of cavitation, etc., may be at least largely avoided

BRIEF DESCRIPTION OF THE DRAWINGS

Exemplary embodiments of the invention are described in more detail below with reference to the drawing. In the drawing.

DETAILED DESCRIPTION OF THE INVENTION

Figure 1:
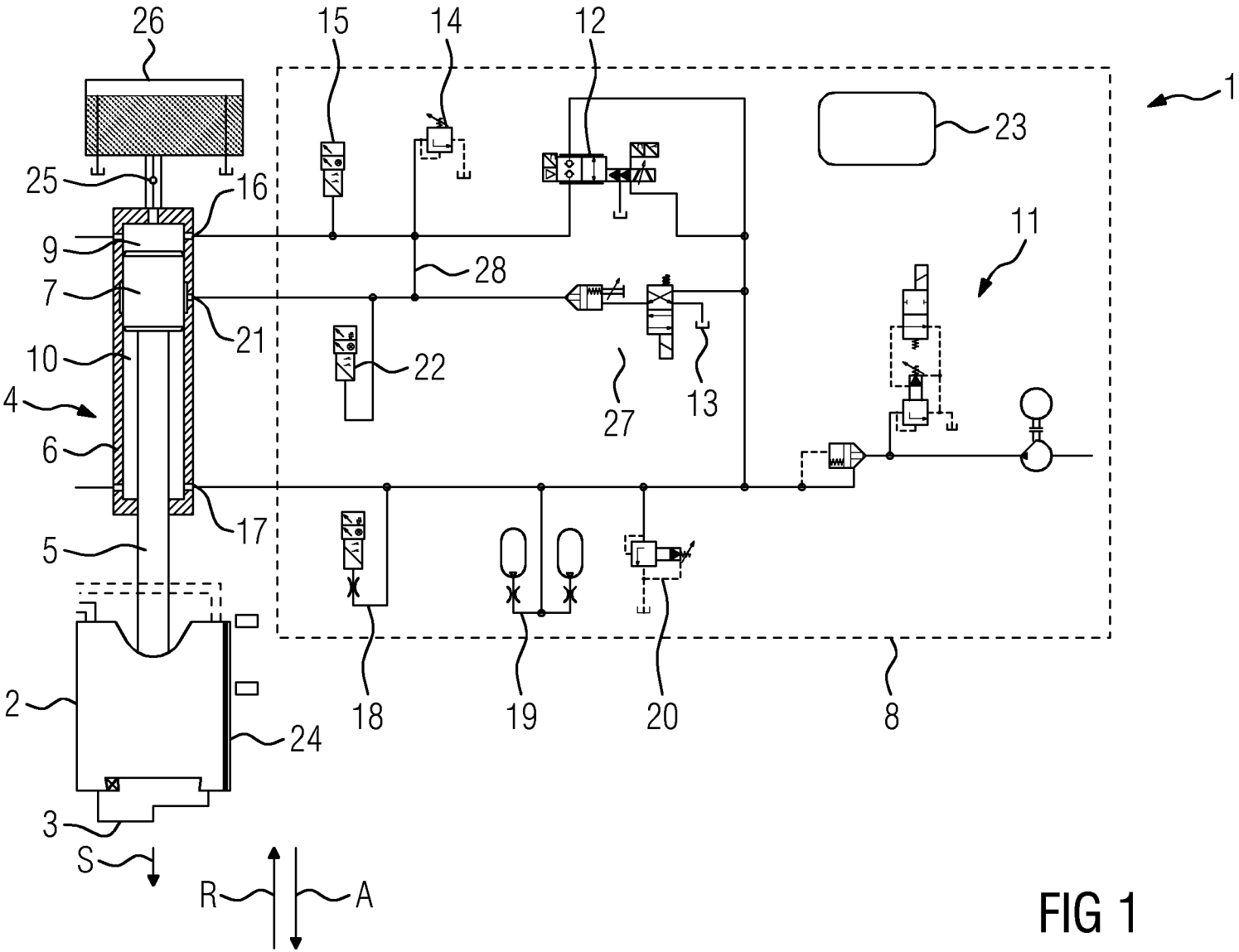
FIG. 1 shows schematically an example of the structure of a first embodiment of a forging hammer.

FIG. 1 shows schematically an example of the structure of a hydraulically operated forging hammer 1 of a first exemplary embodiment. The forging hammer 1 is an example of a forming machine.

The forging hammer 1 comprises a ram 2 with a tool 3 attached thereto for forming a workpiece (not shown).

The ram 2 is coupled to a hydraulic cylinder 4. More precisely, the ram is mechanically coupled via a piston rod 5 to a piston 7 that is movable in a cylinder tube 6.

The hydraulic cylinder 4 is controlled via a hydraulic circuit 8. A first working chamber 9 of the hydraulic cylinder 4 and a second working chamber 10 are connected to the hydraulic circuit 8 via hydraulic lines. A pressing surface of the piston 7, also called the piston surface, faces the first working chamber 9, and a retraction surface of the piston 7, also called the annular surface, which faces away from the pressing surface, faces the second working chamber 10.

The hydraulic circuit 8 comprises a pump unit 11 with a motor-driven pump and control valves, the pump unit 11 being configured to generate a predefined system pressure.

Downstream of the pump unit 11 is a control valve or directional control valve 12 with a safety stage, which separates the pump unit 11, the second working chamber 10 and the storage unit 19 from the first working chamber 9 in a first directional switching position, and connects the first working chamber 9 to the pump unit 11, the second working chamber 10 and the storage unit 19 in a second directional switching position. The directional control valve 12 forms an impact valve for regulating a working stroke or a forging impact.

A brake valve 14 and a first pressure sensor 15 are provided between the directional control valve 12 and the first working chamber 9. The directional control valve 12, the brake valve 14, and the first pressure sensor 15 are connected to the first working chamber 9 via a first connection 16 present at an upper end of the cylinder tube 6.

The pump unit 11 is connected to a second connection 17 provided at a lower end of the cylinder tube 6. A second pressure sensor 18, a pressure repository 19 and a safety valve 20 are attached to the hydraulic line running between the pump unit 11 and the second connection 17.

A third connection 21 on the cylinder 6, located between the first connection 16 and the second connection 17, leads to a valve 27 which may selectively block the line leading to the third connection or switch it to a hydraulic tank 13. The line further comprises a third pressure sensor 22 and a throttle 28, by means of which a connection from the first connection 16 to the valve 27 is realized. The third connection 21 is closer to the first connection 16, for example in an upper third of the cylinder tube 6 that comprises the first connection 16.

The hydraulic circuit 8 further comprises a regulating unit 23, which is connected via data, control and regulation lines (not shown) to the components of the forging hammer 1 that are to be regulated or controlled, for example the pump unit 11, the directional control valve 12, the pressure sensors 15, 18, 22 and a path measuring unit 24. The path measuring unit 24 is configured to detect the position or the path travelled by the ram 2 and/or to determine the speed of the ram 2, e.g. from a path measurement.

The first working chamber 9 is connected to a reservoir 26 via a suction valve 25 at a connection present at an upper end of the cylinder tube 6.

In the case of the forging hammer 1 according to FIG. 1, the regulating unit 23, in particular the hydraulic circuit 8, is configured to adjust the impact energy generated by the kinetic energy of the ram 2 for forming a workpiece, in particular to adjust a setpoint speed corresponding to the impact energy, as will be described in more detail below.

Starting from the situation shown in FIG. 1, in which the ram 2 and correspondingly the piston 7 are in an upper reversal point, the ram 2 and tool 3 are accelerated by means of the first working chamber 9 being pressurized with hydraulic fluid, in particular hydraulic oil, via the directional control valve 12. Accordingly, the first working chamber 9 fills, as a result of which the piston 7 and correspondingly the ram 2 in a working stroke A move downwards, i.e. onto the workpiece that is to be formed. When the first working chamber 9 is pressurized, the ram 2 coupled to the piston 7 is accelerated.

The hydraulic circuit 8 is configured in such a way that the ram 2 is accelerated to a predefined or predefinable setpoint speed, corresponding to a predefined or predefinable impact energy.

When the piston 7 reaches the lower reversal point located in the region of the second connection 17, forming of a workpiece takes place at the forming point, with the ram 2 transferring the impact energy resulting from the setpoint speed to the workpiece.

The forming of the workpiece is followed by a return stroke R. The hydraulic pressure that is constantly present in the second work chamber 10 has an accelerating effect on the piston 7 and, accordingly, on the ram 2 in the return stroke direction. During the return stroke, the fluid present in the first hydraulic chamber 9 may flow via the third connection 21 to the valve 27. At least during the return stroke, this opens the way to the hydraulic tank 13, so that the hydraulic fluid may flow off there.

If the piston 7 passes over or closes the third connection 21 at the end of the return stroke phase or in the upper third of the cylinder 6, the hydraulic fluid flows from the first connection 16 via the throttle 28 to the valve 27 until the piston 7 and accordingly the ram 2 with tool 3 finally stop, which valve 27 is still switched to the hydraulic tank 13. The directional control valve 12 is completely or at least substantially closed during the entire return stroke phase.

Working stroke A and return stroke R form a working cycle of the forging hammer 1 that may be run through repeatedly.

The regulation or control of the working stroke A and return stroke R is described in more detail below.

The directional control valve 12 represents an example of a valve with an adjustably variable volume flow. Depending on which voltage or current, in particular which control or regulation signals, are applied to the directional control valve 12, the latter may be opened and closed steplessly. In particular, the directional control valve 12 may be opened and closed in a specific manner, for example in the form of a ramp, by corresponding regulation or control signals which are determined or generated by the regulation unit 23. Furthermore, the regulation unit 23 and the directional control valve 12 are configured, by way of a non-limiting example, with a cam controller, such that the opening time may be controlled for a predefined time, for example with an accuracy of 0.5 ms. Therefore, the volume flow of the directional control valve 12 may be adjusted and varied, with overall several manipulated variables being available for control of the directional control valve 12, i.e. the valve opening as such, and the opening time and the time profile of the valve opening.

The hydraulic circuit 8 and the regulation unit 23 are configured in such a way that the volume flow of the directional control valve 12 is controlled as a function of a setpoint speed of the ram 2 that is to be achieved in an acceleration phase of a working stroke A.

It should also be mentioned at this point that, in the illustrated embodiment of the forging hammer, the ram is moved up and down parallel to the direction of gravity S.

Figure 2:
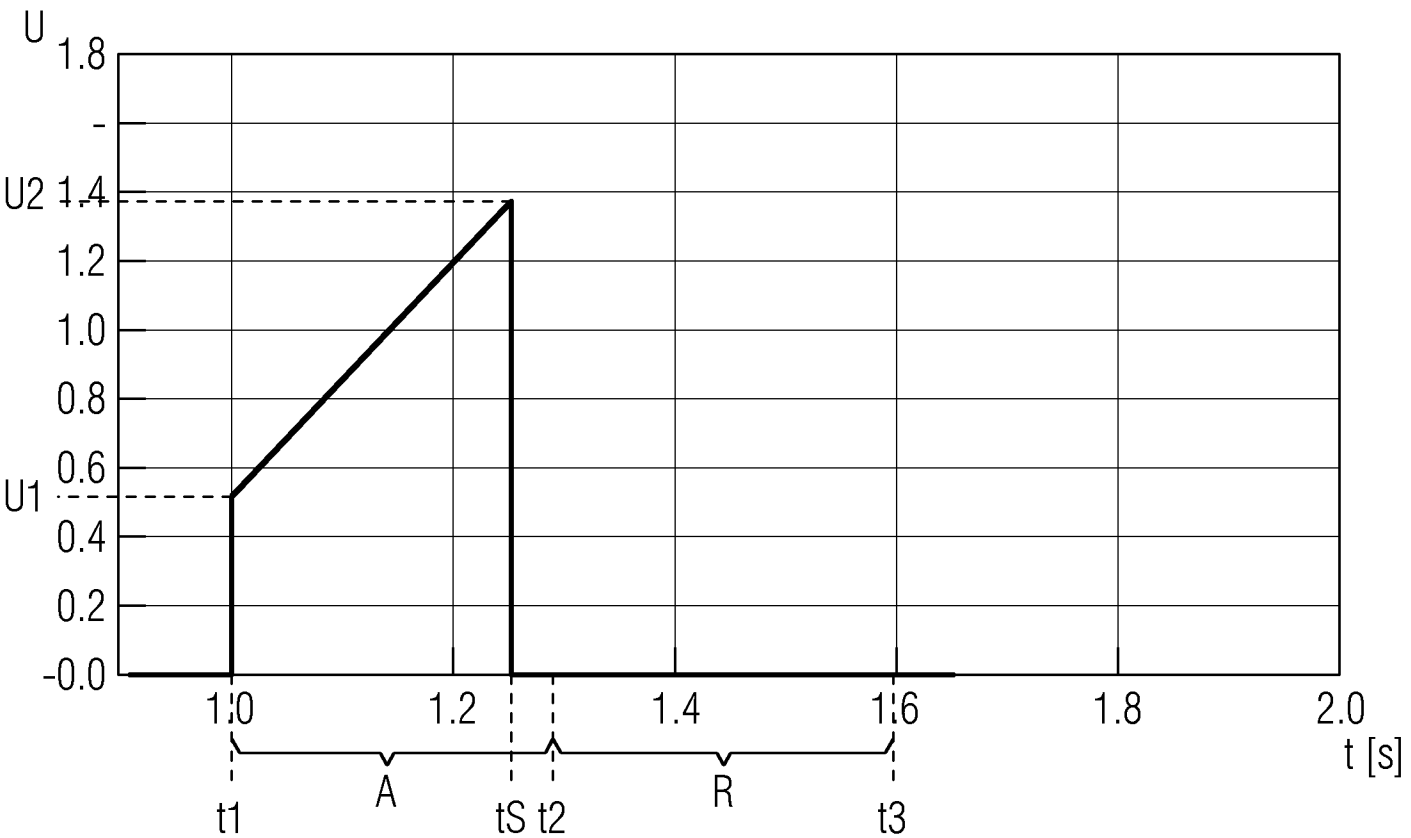
FIG. 2 shows schematically an example of a voltage applied to a directional control valve of the forging hammer used as an impact valve of the first embodiment, as a function of time for a work cycle.

FIG. 2 shows in this connection an example of the voltage U applied to the directional control valve 12 as a function of the time t for a working cycle comprising working stroke A and return stroke R. Starting from the situation shown in FIG. 1 at the beginning of the working stroke at the first point in time t1, the directional control valve 12 is controlled with a first voltage U1. Hydraulic fluid is applied to the first working chamber 9 via the directional control valve 12 in accordance with the opening width of the directional control valve 12 corresponding to the first voltage U1, the system pressure being present at the input of the directional control valve 12. The ram 2 is accelerated by the hydraulic fluid entering the first working chamber 9 and by the force of gravity S acting on the ram 2. In the further course, the voltage U applied to the directional control valve 12 is increased according to a ramp up to a second voltage U2.

The initial first voltage U1, the ramp and the second voltage U2 are regulated or adjusted by the regulating unit 23 in such a way that the setpoint speed required or desired for the respective forming process, that is to say the desired impact energy, is reached at a second point in time t2. The voltages U1 and U2 and the ramp may, for example, be taken from a table of values for setpoint speeds or impact energies, in particular specifically for a predefined work cycle, or may be set accordingly.

Corresponding tables of values may be obtained, for example, by simulation and/or testing of the percussion hammer. In a simulation, for example, parameters such as the weight of ram 2 and of the components moved with ram 2 (e.g. piston rod 5, piston 7, tool 3), the technical data of the hydraulic cylinder 4 (e.g. total stroke, pressing surface) and the operating parameters of the hydraulic circuit 8 (e.g. system pressure, properties of the hydraulic fluid, temperature) may be used.

Besides a ramp, i.e. a linear function of time, other functions, in particular non-linear ones, may also be considered.

After the setpoint speed is reached at the time tS, the directional control valve 12 in the forging hammer 1, which in the embodiment according to FIG. 1 comprises the suction valve 25, is closed. At this point in time, hydraulic fluid may flow into the first cylinder chamber 9 via the suction valve 25. After the forming, the return strokes carried out as described above.

After the ram 2 has been braked at the upper reversal point, the regulating unit 23 may regulate the hydraulic circuit 8, in particular the directional control valve 12, for a subsequent work cycle, the work cycle being able to be executed in accordance with the movement, regulation, and control sequence described above.

Figure 3:
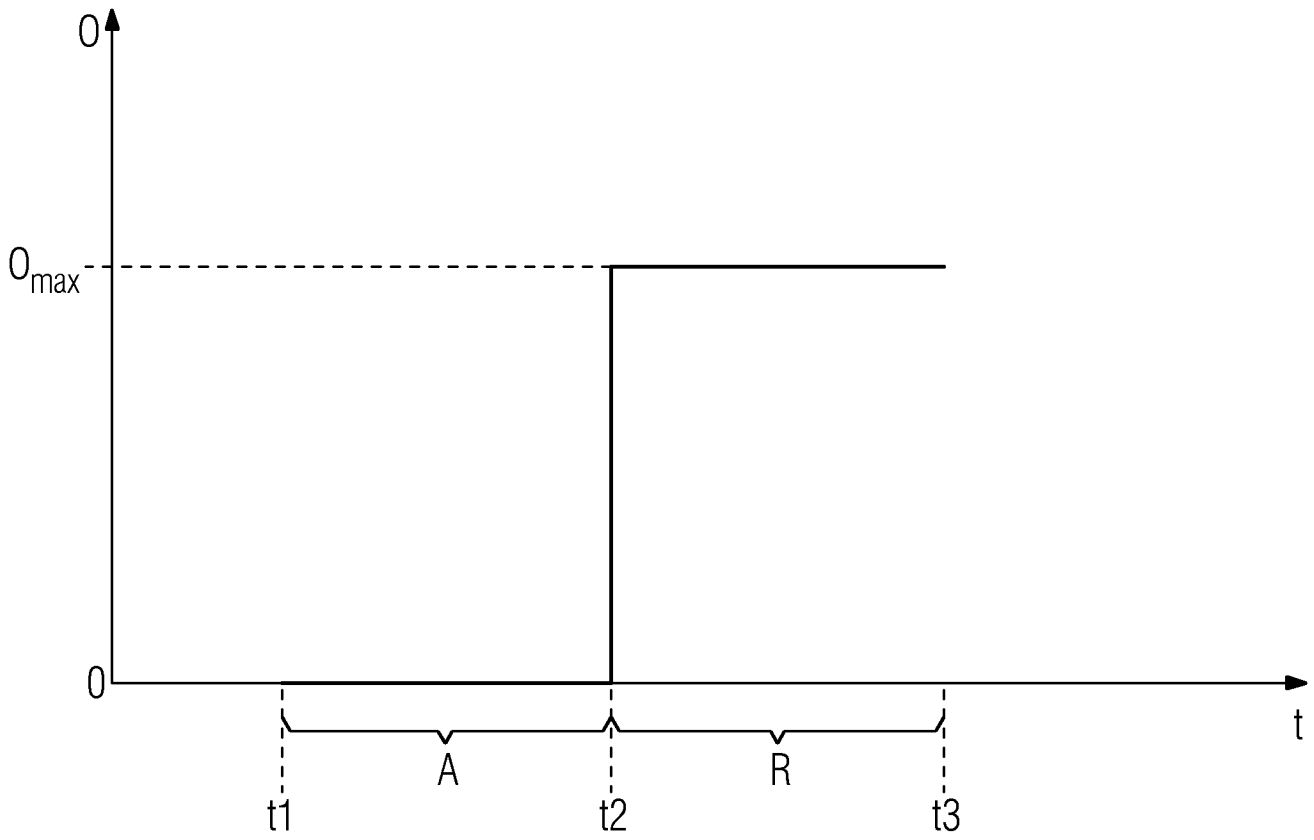
FIG. 3 shows an opening diagram of a return valve in the operation of the forging hammer of the first embodiment.

FIG. 3 shows an opening diagram of the valve 27 (return stroke valve) during a working cycle (R, A) of the forging hammer 1. The valve 27 is closed during the working stroke A and is opened after the forming (time t2), as a result of which the first working chamber 9 is connected to the hydraulic tank 13. As a result, during the return stroke, the hydraulic fluid may flow out of the first working chamber 9 via the third connection 21 and, after the piston 7 has passed over the third connection 21, via the throttle 28 into the hydraulic tank 13.

Figure 4:
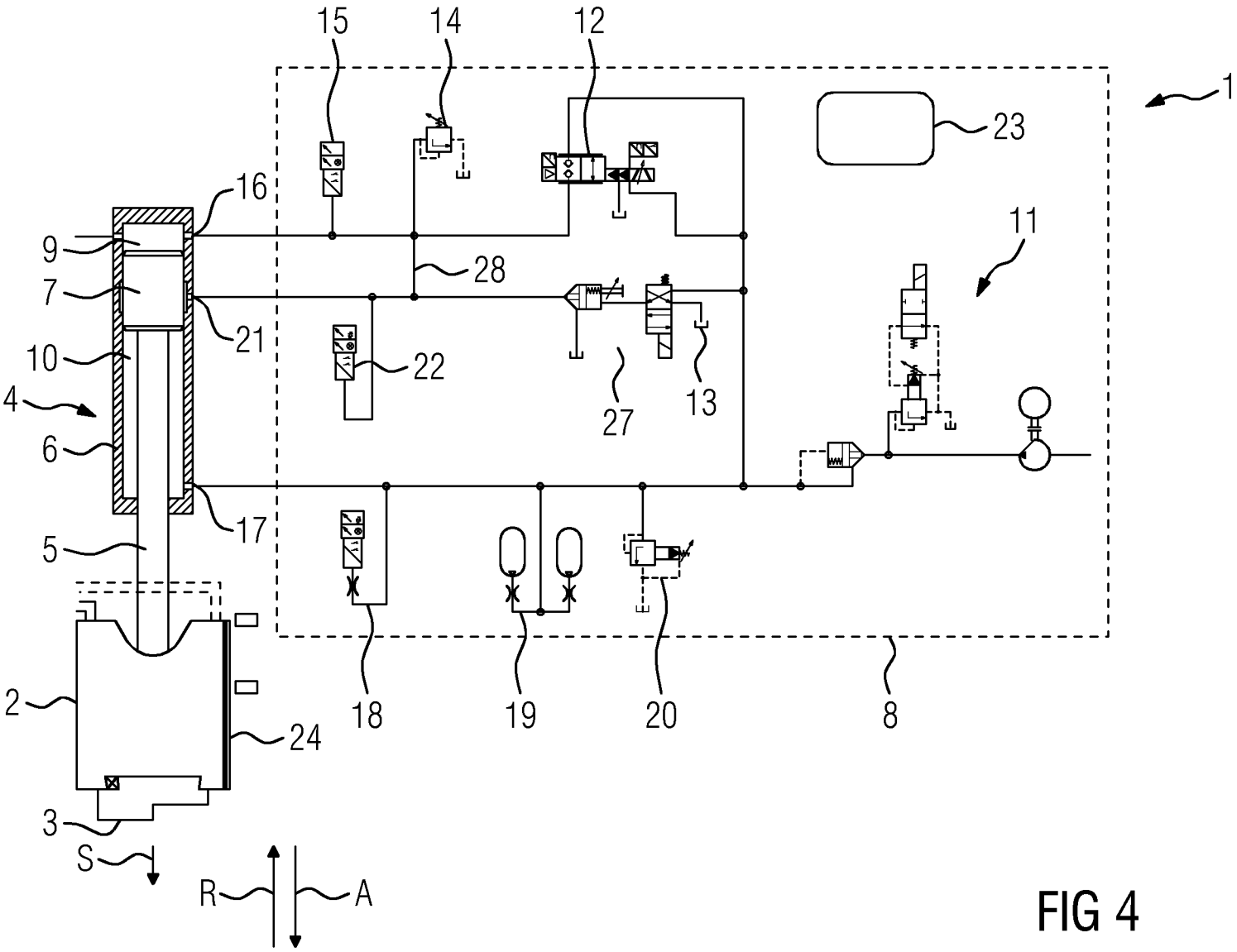
FIG. 4 shows schematically an example of the structure of a second embodiment of a forging hammer.

FIG. 4 shows schematically an example of the structure of a second embodiment of a forging hammer 1. In FIG. 4, identical or functionally identical components and elements are designated with the same reference signs as in FIG. 1.

In contrast to the forging hammer 1 of the first embodiment, the forging hammer 1 of the second embodiment has no suction valve and accordingly also no suction tank. In the forging hammer 1 of the second embodiment, in order for hydraulic fluid to be able to flow into the first working chamber 9 in the braking phase after the setpoint speed has been reached, the regulating unit 23 is configured in such a way that it does not completely close the directional control valve 12 after the setpoint speed has been reached. The regulating unit 23 controls the directional control valve 12 in such a way that sufficient hydraulic fluid may flow in and the pressure prevailing in the first working chamber 9 remains above the cavitation pressure of the hydraulic fluid. As in the first embodiment, the braking action is achieved by the system pressure present in the annular space of the second working chamber 10.

In particular, the directional control valve 12 may be regulated in such a way that the pressure in the first working chamber 9 is considerably lower than the system pressure but is above the cavitation pressure. With such a control of the directional control valve 12 in the movement phase, essentially the same braking effect may be achieved as when using the suction valve 25, with the braking being effected, as has been mentioned, by the system pressure present in the annular space of the second working chamber 10. The volume flow of the directional control valve 12 may be regulated, for example, such that the pressure in the first working chamber 9 is between 2 and 6 bar, above the cavitation pressure of the hydraulic fluid.

The control of the directional control valve 12 in the movement phase in the second embodiment of the forging hammer according to FIG. 4 may take place, for example, on the basis of the pressure detected by the first and/or third pressure sensor 15, 22, respectively.

The use of the directional control valve 12 in the operating mode according to the second embodiment has the advantage over the operating mode of the first embodiment that directional control valves generally have shorter reaction times than suction valves, and therefore cavitation may be avoided with higher certainty. Particularly in the transition phase from the acceleration phase to the movement phase of the working stroke, the short reaction times of directional control valves offer an advantage over suction valves, which react comparatively slowly. However, it is particularly advantageous against formation of cavitation that the directional control valve 12 may be continuously adjusted from the acceleration volume flow to the post-flow volume flow, e.g. according to a linear or non-linear other function, without having to be completely closed in the meantime. Accordingly, the hydraulic fluid flow cannot be interrupted, and cavitation is substantially or completely avoided.

Figure 5:
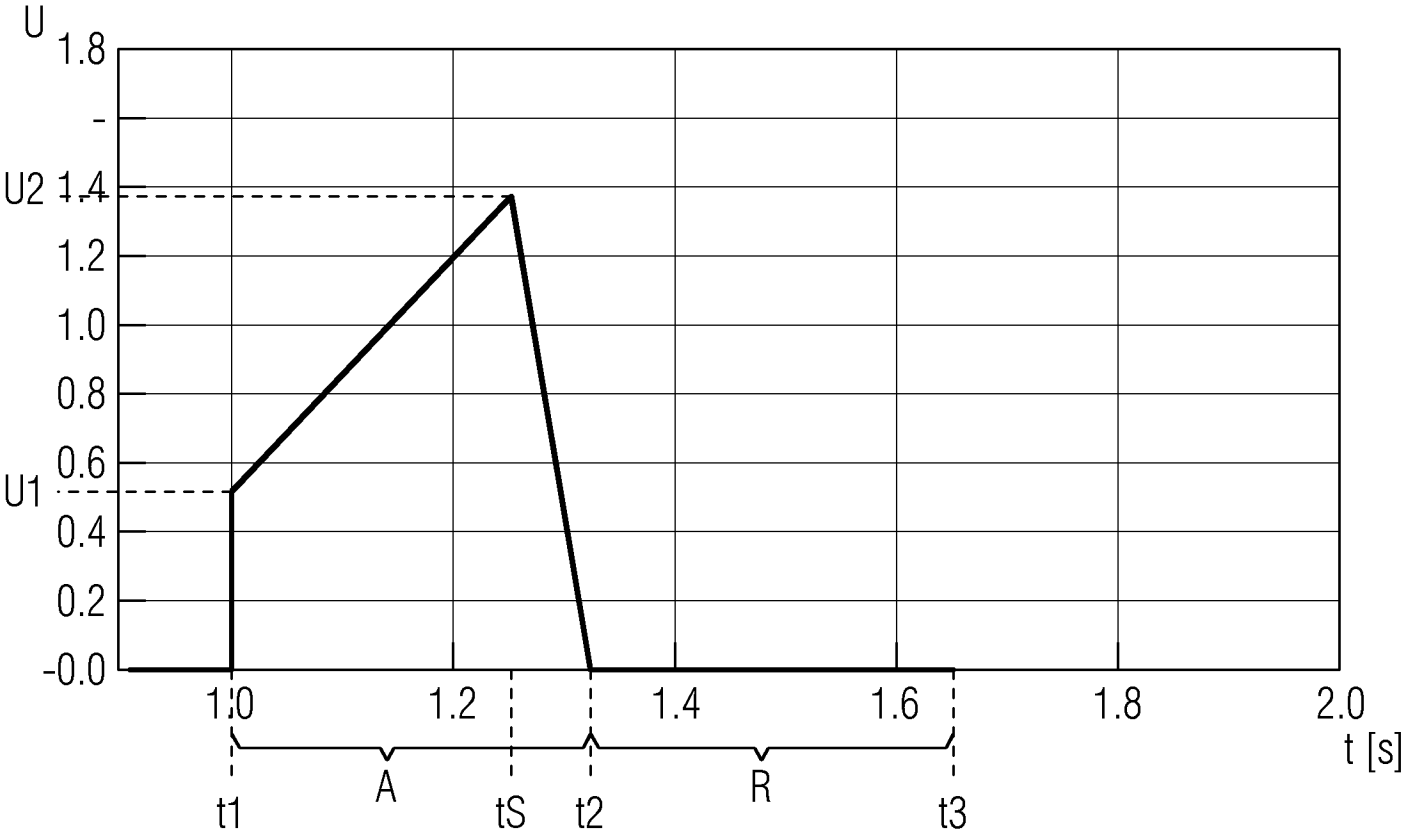
FIG. 5 shows schematically an example of a voltage applied to a directional control valve of the forging hammer used as an impact valve of the second embodiment, as a function of time for a work cycle.

FIG. 5 shows, by way of example and schematically, a voltage applied to the impact valve 12 of the second embodiment of the forging hammer 1 as a function of the time for a working stroke A. As can be seen from FIG. 5, the directional control valve 12 may be controlled analogously to the first embodiment in the acceleration phase of the working stroke A until the setpoint speed is reached at the time tS. However, in the operating mode according to the second embodiment, the directional control valve 12 is not completely closed when the setpoint speed is reached, but instead is controlled, for example according to a linear function, in such a way that hydraulic fluid may continue to flow into the first working chamber 9. As has already been mentioned, the control is configured in such a way that the pressure in the first hydraulic chamber 9 is above the cavitation pressure of the hydraulic fluid. Since the directional control valve 12 is not completely closed after the setpoint speed has been reached in the braking phase of the working stroke A, it is also possible to prevent the hydraulic fluid flows from stalling.

Figure 6:
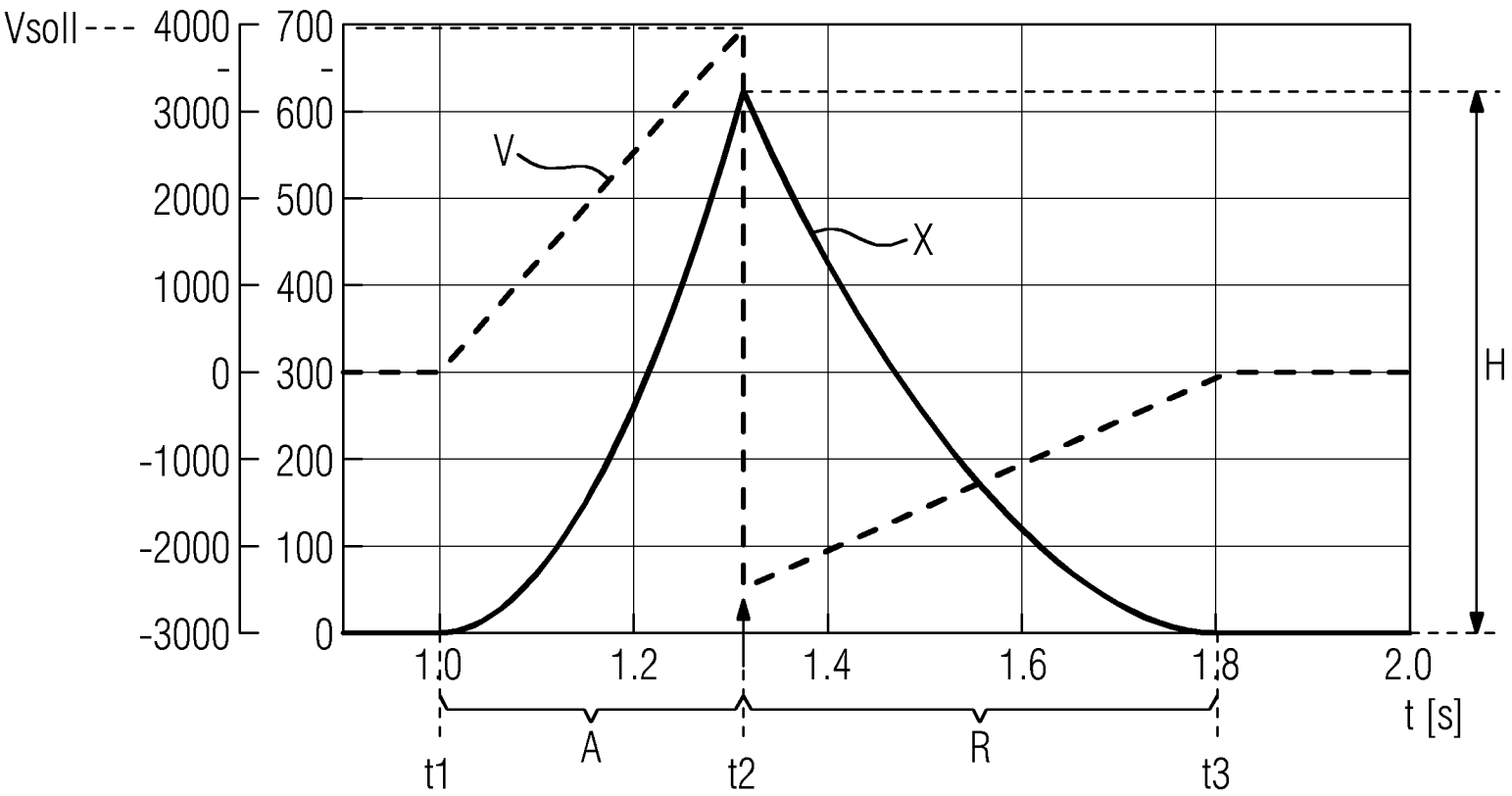
FIG. 6 shows schematically an example of a position and speed diagram of a ram during a working cycle.

FIG. 6 shows a position and speed diagram of the ram 2 during a working cycle of the forging hammer of the first and second embodiments. More specifically, FIG. 6 shows the profile of the position X of the ram 2 and the speed V of the ram 2 as a function of the time t. The first to third times t1 to t3 correspond to those of FIGS. 2, 3 and 5.

From the first time t1, the ram 2 is accelerated by appropriate control of the volume flow of the directional control valve 12, the control in the present example being such that the speed V increases linearly until the setpoint speed Vsoll is reached. With the proposed invention, however, other speed-time curves, i.e. not just linear curves, may also be implemented.

Once the setpoint speed Vsoll has been reached, the hydraulic circuit 8 is controlled according to one of the operating modes described above, the movement phase of the working stroke A, in which the ram 2 moves at a substantially constant setpoint speed Vsoll, is not shown resolved over time in FIG. 6.

In the present example, the control in the movement phase (braking phase) takes place in such a way that the setpoint speed Vsoll is reached just shortly before the forming point, such the suction phase in the operating mode of the first embodiment or the post-flow phase in the operating mode of the second embodiment is advantageously shortened.

The position X of the ram 2 changes corresponding to the linear speed change according to a parabolic function from the initial position 0 over the stroke H executed in the work cycle.

During the forming process, at the second time t2, the ram 2 is decelerated and moves back to the starting position 0 on account of the rebound energy and the above-described return stroke control via the hydraulic circuit 8.

For the return stroke, the hydraulic circuit 8 is regulated as described above, with the ram 2 in the present example experiencing a linear change in speed V during the return stroke. At the top reversal point at the third time t3, the ram 2 has zero speed.

Since the retraction surface of the piston 7 is an annular surface and is therefore smaller than the pressing surface of the piston 7, the acceleration of the ram 2 during the return stroke R is less than during the working stroke A. In FIG. 6, the braking process in the region of the upper reversal point is not shown in a time-resolved manner.

Instead of the directional control valve 12, a controllable pump, for example a servo pump, may also be used. With such a pump, the volume flow may be adjusted and varied, in particular controlled, as described above, analogous to the directional control valve 12.

The described embodiments of a forging hammer 1, in general of a correspondingly configured forming machine with appropriate control, have in particular the following advantages.

By using valves or pumps with an adjustably variable volume flow, it is possible to change the supply of hydraulic fluid comparatively gently, and abrupt changes may be avoided. This affords in particular the advantage that cavitation may be avoided, which cavitation may be caused by a sudden change in the volume flow, for example by a stall in the hydraulic fluid flow due to the inertia of the hydraulic fluid.

The regulation or control of the hydraulic circuit that is possible with the proposed forming machine makes it possible, with a predefined setpoint speed or impact energy or energy preselection, to extend the acceleration phase to just shortly before the impact of the ram 2 or tool 3 on the workpiece, or to accelerate the ram 2 in a targeted manner to just shortly before it hits the workpiece, so that the suction phase, in which undesired cavitation may occur, and the post-flow phase may be shortened to a minimum or optimized. For example, the hydraulic circuit may regulate the forming machine and control the volume flow such that, at low setpoint speeds or low forming energies, the acceleration of the ram 2 set over the entire stroke is lower than at high setpoint speeds or high forming energies.

When using a path measuring unit 24 in combination with directional control valves 12 or pumps that may be controlled comparatively quickly and on the basis of comparatively short reaction times of such actuating units, the working stroke may be traversed in a targeted and regulated manner.

Furthermore, advantages with regard to the construction of the hydraulic circuit 8 may be achieved with the proposed forming machine. In particular, it is possible to dispense with the comparatively complex impact valves that are used in forging hammers 1 known from the prior art. In embodiments without a suction valve 25, as is the case in the second embodiment according to FIG. 4, structural simplifications may be achieved insofar as the suction valve 25 and the reservoir 26 and associated hydraulic lines and components may be omitted.

A hydraulic forming machine is made available, more particularly a forging hammer 1, for workpiece forming, comprising a hydraulic cylinder 4 for driving a ram 2 configured for workpiece forming, and a hydraulic circuit configured for operation of the hydraulic cylinder 4, wherein the hydraulic circuit 8 has a valve 12 and/or actuator with an adjustably variable volume flow via which a first hydraulic working chamber 9 of the hydraulic cylinder 4, used to accelerate the ram 2 during the execution of a working stroke A for workpiece forming, may be provided with hydraulic fluid. The hydraulic circuit 8 is configured to adjust and vary the volume flow of the valve 12 or actuator, depending on a setpoint speed Vsoll of the ram 2 to be achieved in an acceleration phase of a working stroke A, and to optimize the subsequent movement phase of the working stroke A.

The operating modes of the forging hammers 1 of the two described embodiments have in particular the advantage, which may be achieved more or less equally in each case, that cavitation in the hydraulic fluid may be avoided after the setpoint speed has been reached. This is achieved in particular by the fact that the ram is accelerated in a regulated manner, such that the movement phase, i.e. braking phase, of the working stroke that follows the acceleration phase is optimized, in particular as regards the occurrence of cavitation.

In the case of forging hammers known from the prior art, the hydraulic circuit comprises a hydraulic fluid reservoir, the suction tank, which is connected to the first working chamber via a suction valve. In these embodiments, the suction valve, which is designed as a non-return valve, opens above a certain pressure ratio between suction tank and piston chamber and hydraulic fluid. In the forging hammers known from the prior art, acceleration in the acceleration phase of the working stroke is always carried out with maximum pressure and volume flow. For high setpoint speeds, this results in long acceleration phases and short braking or suction phases. By contrast, in the case of low setpoint speeds, this results in shorter acceleration phases and longer braking or suction phases. Since the suction is generally critical in terms of cavitation, especially in the case of comparatively long suction phases, and the suction phase depends on many factors that are difficult or impossible to influence, such as manufacturing tolerances of the components of the suction valve (spring stiffness, friction of the running surface, mass, etc.), temperature of the hydraulic medium, properties of the fluid itself, filling level in the suction tank or container (geodetic pressure), etc., the known forging hammers are to be viewed rather critically with regard to functional reliability (e.g. cavitation).

Based on this, it is a finding of the underlying invention that, by suitable regulation/control of the acceleration phase, the suction may be optimized with regard to functional reliability (embodiment according to FIG. 1) or even completely eliminated (embodiment according to FIG. 4). The latter permits, for example, cavitation-free operation.

According to one aspect of the invention, the suction may be minimized or optimized. The maximum pressure (e.g. the system pressure, in particular the maximum pressure that is or may be made available by the hydraulic system for charging the hydraulic cylinder to execute a stroke) may then always be applied to the actuator, and the volume flow and thus the acceleration pressure in the first working chamber may be adapted to the setpoint speed. This means that, for example, an almost identical acceleration path may always be set, regardless of whether a high or low setpoint speed is to be achieved. In this way, the braking distance or suction phase may be minimized as far as possible, such that the associated lack of functional reliability is minimized. The optimization of the braking distance or of the suction phase may in particular take into account the inertia, e.g. of the hydraulic fluid column or of the suction valve with its components, in such a way that the suction phase is always greater than the reaction time of the system. The proposed invention thus permits an optimization of the braking distance or of the suction phase in order to increase the functional reliability. The braking phase or the ratio of acceleration phase to braking phase may be adjusted using the method according to the invention. It may thus be ensured that the time needed for setting the volume flow required to avoid cavitation, or the stroke required for this purpose, are available.

According to a further aspect of the invention, the suction may be eliminated, or a cavitation-free drive may be implemented. Here, the hydraulic fluid is supplied via the impact valve during the braking phase, and therefore no suction valve and suction tank are required. The volume flow required to avoid cavitation-critical pressure is fed to the first working chamber via the impact valve. For this purpose, the impact valve is preferably pressure-controlled from the end of the acceleration phase, i.e. the opening cross section and the associated volume flow are changed in real time depending on the conditions in the piston chamber. In particular, it is possible to avoid a situation where the impact valve is suddenly closed after the end of the acceleration phase. Rather, the impact valve may be closed continuously until the (pressure) regulation of the impact valve begins. The parameters required to control the impact valve may be determined or fed back, for example, by a pressure sensor installed on the first hydraulic working chamber. A stalling of the hydraulic fluid column or cavitation and their damage are thus substantially or completely avoided.

Overall, it can be seen that the object on which the invention is based is achieved.

LIST OF REFERENCE SIGNS

1 forging hammer
2 ram
3 tool
4 hydraulic cylinder
5 piston rod
6 cylinder tube
7 piston
8 hydraulic circuit
9 first working chamber
10 second working chamber
11 pump unit
12 directional control valve (impact)
13 hydraulic tank
14 brake valve
15 first pressure sensor
16 first connection
17 second connection
18 second pressure sensor
19 pressure reservoir
20 safety valve
21 third connection
22 third pressure sensor
23 control unit
24 path measuring unit
25 suction valve
26 reservoir
27 valve
28 throttle
A working stroke
R return stroke
S force of gravity
U voltage
t time
G speed
X position
H stroke
O open position

I claim:

1. A forging hammer for workpiece forming, comprising:

a hydraulic cylinder for driving a ram configured for workpiece forming, which ram is mechanically coupled to the hydraulic cylinder, and a hydraulic circuit configured to operate the hydraulic cylinder and having an actuator for setting a volume flow of hydraulic fluid for filling a first hydraulic working chamber of the hydraulic cylinder during the execution of a working stroke (A) immediately preceding the workpiece forming, with an acceleration phase for accelerating the ram to a setpoint speed (Vsoll), and a movement phase which follows the acceleration phase and in which the setpoint speed (Vsoll) is substantially maintained, wherein the hydraulic circuit and the actuator are configured to:

adjust and vary the volume flow in the acceleration phase as a function of the setpoint speed (Vsoll) such that the setpoint speed (Vsoll) is reached, and reduce the volume flow in the subsequent movement phase to a post-flow volume flow, in such a way that a hydraulic pressure prevailing in the movement phase in the first hydraulic working chamber is substantially above a cavitation pressure of the hydraulic fluid, wherein the hydraulic circuit is further configured to adjust and vary the volume flow in such a way that the volume flow in the acceleration phase is adjusted in such a way that the movement phase corresponds to a range of 10% to 30% of the stroke of the hydraulic cylinder.

2. The forging hammer according to claim 1, wherein the actuator comprises at least one of:

an open-loop or closed-loop control valve;

an open-loop or closed-loop control pump; and a directional control valve.

3. The forging hammer according to claim 1, further comprising:

at least one pressure sensor configured to measure the hydraulic pressure prevailing in at least one of the first and/or second hydraulic working chamber during at least one of the working stroke and/or return stroke, and wherein the hydraulic circuit or the actuating unit is configured to adjust and vary the volume flow during a working cycle of the ram at least in the movement phase as a function of the measured hydraulic pressure.

4. The forging hammer according to claim 1, wherein:

the hydraulic circuit is configured to adjust and vary the volume flow in such a way that the hydraulic pressure in the first hydraulic working chamber in the movement phase corresponds to a predefined or predefinable pressure or is within a predefined or predefinable pressure range.

5. The forging hammer according to claim 4, wherein the predefined or predefinable pressure or pressure range is between 2 and 6 bar.

6. The forging hammer according to claim 1, wherein the hydraulic circuit is configured to adjust and vary the volume flow as a function of the setpoint speed (Vsoll) to be respectively achieved.

7. The forging hammer according to claim 6, wherein the hydraulic circuit is configured to dynamically adjust the volume flow based on at least one of a table of values for setpoint speed, measured location data, and speed data (X or V) of the ram.

8. The forging hammer of claim 7, further comprises at least one of a sensor unit for measuring at least one of location and speed data of the ram, and a sensor unit for storing at least one of location data and speed data of the ram.

9. The forging hammer according to claim 1, wherein the hydraulic circuit is configured to:

close the valve or the actuator at least temporarily substantially completely in the movement phase following the acceleration phase, adjust and vary the volume flow in such a way that the acceleration phase is maximized while at the same time the movement phase is minimized, or, for a working stroke for accelerating the ram, starting from a reversal point located in the movement profile of the ram with zero ram speed and towards the setpoint speed (Vsoll), use only part of the total stroke of the hydraulic cylinder.

10. The forging hammer according to claim 1, wherein the hydraulic circuit is configured to adjust and vary the volume flow in the acceleration phase the volume flow in the acceleration phase in such a way that the length of the acceleration phase and accordingly the length of the movement phase or their ratio is set as a function of the setpoint speed (Vsoll) to be achieved in each case.

11. A method for operating a hydraulic forging hammer for workpiece forming, wherein:

in a working stroke (A) executed for the workpiece forming, a ram provided for the workpiece forming is accelerated in an acceleration phase by a hydraulic cylinder mechanically coupled to it, in the working stroke, a first hydraulic working chamber of the hydraulic cylinder is fed with hydraulic fluid via an actuator with an adjustably variable volume flow through a hydraulic circuit, and the hydraulic circuit:

(i) in the acceleration phase, adjusts and varies the volume flow through the actuator as a function of the setpoint speed (Vsoll) in such a way that the setpoint speed (Vsoll) is reached, and (ii) in a movement phase which directly follows the acceleration phase and in which the setpoint speed (Vsoll) is substantially maintained, reduces the volume flow to a post-flow volume flow, in particular regulates it, such that the hydraulic pressure prevailing in the movement phase in the first hydraulic working chamber is substantially above the cavitation pressure of the hydraulic fluid, wherein the volume flow in the acceleration phase is adjusted in such a way that the movement phase corresponds to a range of 10% to 30% of the stroke of the hydraulic cylinder.

12. The method according to claim 11, wherein the actuator is designed as a controllable valve or a controllable pump, and wherein in the method:

controls the volume flow of the actuator as a function of the setpoint speed (Vsoll);

dynamically adjusts and changes the volume flow based on a hydraulic pressure measured in at least one of the first and second hydraulic working chamber by means of a pressure sensor; or varies and adjusts the volume flow in such a way that the hydraulic pressure in the first hydraulic working chamber in the movement phase, which is a braking phase, corresponds to a predefined or predefinable pressure or is within a predefined pressure range.

13. The method according to claim 11 comprising at least one of:

adjusting and varying the volume flow as a function of the setpoint speed (Vsoll) to be achieved in each case;

dynamically adjusting the volume flow based on at least one of a table of values for setpoint speeds, measured location data of the ram, and measured speed data of the ram; or measuring at least one of location and speed data (X or V) of the ram by at least one sensor unit; and storing at least one of location and speed data (X or V) of the ram and using the stored data when setting the volume flow.

14. The method according to claim 13, wherein:

the valve is substantially completely closed at least temporarily in the movement phase, which follows the acceleration, phase, and in the movement phase, hydraulic fluid is supplied to the first hydraulic working chamber substantially completely via a suction valve.

15. The method according to claim 11, wherein:

the volume flow is adjusted and varied, in particular regulated, in such a way that the duration of the acceleration phase is maximized while at the same time the duration of the movement phase is minimized.

16. The method of claim 15, wherein the duration of the movement phase is 10% of the duration of the acceleration phase.

17. The method according to claim 11 comprising at least one of:

adjusting and varying the volume flow as a function of the setpoint speed (Vsoll) to be respectively achieved;

dynamically adjusting the volume flow based on at least one of a table of values for setpoint speeds, measured location, and speed data (X or V) of the ram; and measuring by at least one sensor unit for measuring at least one of a location and speed data of the ram; and storing, by the at least one sensor unit, at least one of the location and speed data of the ram.

18. The method according to claim 11, further comprising at least one of:

closing the valve or the actuator at least temporarily substantially completely in the movement phase following the acceleration phase;

adjusting and varying the volume flow in such a way that the acceleration phase is maximized while at the same time the movement phase is minimized; and for a working stroke for accelerating the ram, starting from a reversal point located in the movement profile of the ram with zero ram speed and towards the setpoint speed (Vsoll), using only part of the total stroke of the hydraulic cylinder.

19. The method of claim 18, wherein for a working stroke for accelerating the ram, starting from a reversal point located in the movement profile of the ram with zero ram speed and as far as the setpoint speed (Vsoll), only a part of the total stroke of the hydraulic cylinder is used, and a subsequent return stroke is correspondingly shortened.

* * * * *